US011432598B1

(12) United States Patent
Grell

(10) Patent No.: US 11,432,598 B1
(45) Date of Patent: Sep. 6, 2022

(54) EXERCISE PAD DEVICE AND RELATED METHODS

(71) Applicant: Devan Grell, Chandler, AZ (US)

(72) Inventor: Devan Grell, Chandler, AZ (US)

( * ) Notice: Subject to any disclaimer, the term of this patent is extended or adjusted under 35 U.S.C. 154(b) by 1171 days.

(21) Appl. No.: 15/453,883

(22) Filed: Mar. 8, 2017

Related U.S. Application Data

(60) Provisional application No. 62/409,545, filed on Oct. 18, 2016.

(51) Int. Cl.

| | |
|---|---|
| ***A63B 71/00*** | (2006.01) |
| ***A41D 13/015*** | (2006.01) |
| ***A41D 13/05*** | (2006.01) |
| ***A41D 31/28*** | (2019.01) |

(52) U.S. Cl.
CPC ..... *A41D 13/015* (2013.01); *A41D 13/0562* (2013.01); *A41D 13/0568* (2013.01); *A41D 31/285* (2019.02); *A63B 71/0054* (2013.01)

(58) Field of Classification Search
CPC ..... A41D 13/015; A41D 13/0562; A41D 13/0568; A41D 31/005; A63B 71/0054; A63B 21/078; A63B 36/0059; A63B 21/065; A63B 21/40; A63B 21/4001; A63B 21/4009
See application file for complete search history.

(56) References Cited

U.S. PATENT DOCUMENTS

| | | | | |
|---|---|---|---|---|
| 5,933,874 | A * | 8/1999 | Randolph | A41D 13/0518 2/267 |
| 6,224,518 | B1 * | 5/2001 | Weiss | A63B 21/078 482/104 |
| 6,749,159 | B1 * | 6/2004 | Hess | A47B 21/0371 248/118 |
| 7,824,319 | B2 * | 11/2010 | Carlesimo | A63B 21/00047 446/85 |
| 9,005,087 | B1 * | 4/2015 | Betoney, Jr. | A63B 21/06 482/104 |
| 9,138,613 | B2 * | 9/2015 | Ferrell | A63B 21/0783 |
| 2008/0103460 | A1 | 5/2008 | Close et al. | |
| 2008/0214361 | A1 * | 9/2008 | Oster | A63B 21/4037 482/23 |
| 2009/0181836 | A1 * | 7/2009 | Schneider | A63B 6/00 482/141 |
| 2012/0054943 | A1 | 3/2012 | Tao et al. | |

(Continued)

FOREIGN PATENT DOCUMENTS

| | | |
|---|---|---|
| EP | 2582258 B1 | 2/2017 |
| EP | 2773281 B1 | 8/2017 |

OTHER PUBLICATIONS

Picture of a weight lifting barbell pad. Available at least as early as Oct. 17, 2016.

(Continued)

*Primary Examiner* — Jameson D Collier
(74) *Attorney, Agent, or Firm* — Adam R. Stephenson, Ltd.

(57) ABSTRACT

Specific implementations of an exercise pad device may include: a pad portion including a well, wherein the well may be substantially centered in the pad portion, a protective layer coupled to the pad portion, and a cover coupled to and enclosing the pad portion and the protective layer, wherein the well may be configured to reduce the localized pressure felt by a user when a barbell is placed over the pad while the user performs a hip thrust lift using the barbell.

7 Claims, 4 Drawing Sheets

(56) References Cited

U.S. PATENT DOCUMENTS

| | | | | |
|---|---|---|---|---|
| 2012/0165163 | A1* | 6/2012 | Barrow | A63B 21/078<br>482/93 |
| 2015/0164727 | A1* | 6/2015 | Lopez | A61G 5/10<br>5/653 |

OTHER PUBLICATIONS

Picture of a rolled up yoga mat. Available at least as early as Oct. 17, 2016.

Picture of a foam pad marketed under the tradename AIREX by Airex AG of Sins, Switzerland. Available at least as early as Oct. 17, 2016.

* cited by examiner

EXERCISE PAD DEVICE AND RELATED METHODS

CROSS REFERENCE TO RELATED APPLICATIONS

This document claims the benefit of the filing date of U.S. Provisional Patent Application 62/409,545, entitled "Exercise Pad Device and Related Methods" to Devan Grell which was filed on Oct. 18, 2016, the disclosure of which is hereby incorporated entirely herein by reference.

BACKGROUND

1. Technical Field

Aspects of this document relate generally to devices used to protect a user during exercise, such as a pad used for protection while lifting weights.

2. Background

Weights and barbells are commonly used in exercise and weightlifting. During various exercises, the weight or barbell may rests on various parts of the body of the weightlifter, such as the shoulders of the weightlifter while performing a squat exercise. In other exercises, the weight or barbell is supported by the weightlifter's hands or legs entirely, such as during a leg press exercise.

SUMMARY

Implementations of an exercise pad device may include: a pad portion including a well, wherein the well may be substantially centered in the pad portion, a protective layer coupled to the pad portion, and a cover coupled to and enclosing the pad portion and the protective layer, wherein the well may be configured to reduce the localized pressure felt by a user when a barbell is placed over the pad while the user performs a hip thrust lift using the barbell.

Implementations of an exercise pad device may include one, all, or any of the following:

The protective layer may include a rubber sheet.

The pad portion may further include a closed cell foam.

The closed cell foam may include multiple sheets of closed cell foam.

The well may be substantially conical.

The well may substantially be a pyramidal frustum.

A cushioning foam layer may be coupled to the pad portion and configured to go between the pad portion and the user during the hip thrust lift.

Implementations of an exercise pad device may include: a pad portion having a first side, an opposing second side, and a well, wherein the well may be substantially centered in the pad portion and the well may narrow from an opening of the well in the first side of the pad portion to an end of the well in the pad portion. The exercise pad device may also include a protective layer which may be coupled to the second side of the pad portion and a cover which may be coupled to and enclose the pad portion and the protective layer.

Implementations of an exercise pad device may include one, all, or any of the following:

The protective layer may include a rubber sheet.

The pad portion may further include a closed cell foam.

The pad portion may include multiple layers of closed cell foam.

A cushioning foam layer may be coupled to the pad portion and may be configured to go between the pad portion and the user during the hip thrust lift.

Implementations of an exercise pad device may include: a protective layer coupled to a second side of a plurality of foam layers, wherein each foam layer of the plurality of foam layers includes a hole therethrough, wherein each hole may be substantially centered in each foam layer of the plurality of foam layers, wherein the holes of at least two foam layer of the plurality of foam layers may vary in size relative to one another, wherein the foam layers may be arranged with the largest hole in a foam layer on a first side of the plurality of foam layers and the smallest hole in a foam layer on the second side of the plurality of foam layers. The exercise pad device may also include a cushioning foam layer coupled to the first side of the plurality of foam layers and a cover which may be coupled to and enclose the protective layer, the plurality of foam layers, and the cushioning foam layer.

Implementations of an exercise pad device may include one, all, or any of the following:

The plurality of foam layers may include four layers.

The holes of three foam layers of the plurality of foam layers may vary in size relative to each other.

The holes may be substantially rectangular.

The thickness of the plurality of foam layers may be substantially twice as thick as a thickness of the cushioning foam layer.

The protective layer may include a rubber sheet.

The plurality of foam layers may further include a closed cell foam.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended exercise pad device will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such exercise pad devices, and implementing components and methods, consistent with the intended operation and methods.

Figure 1:
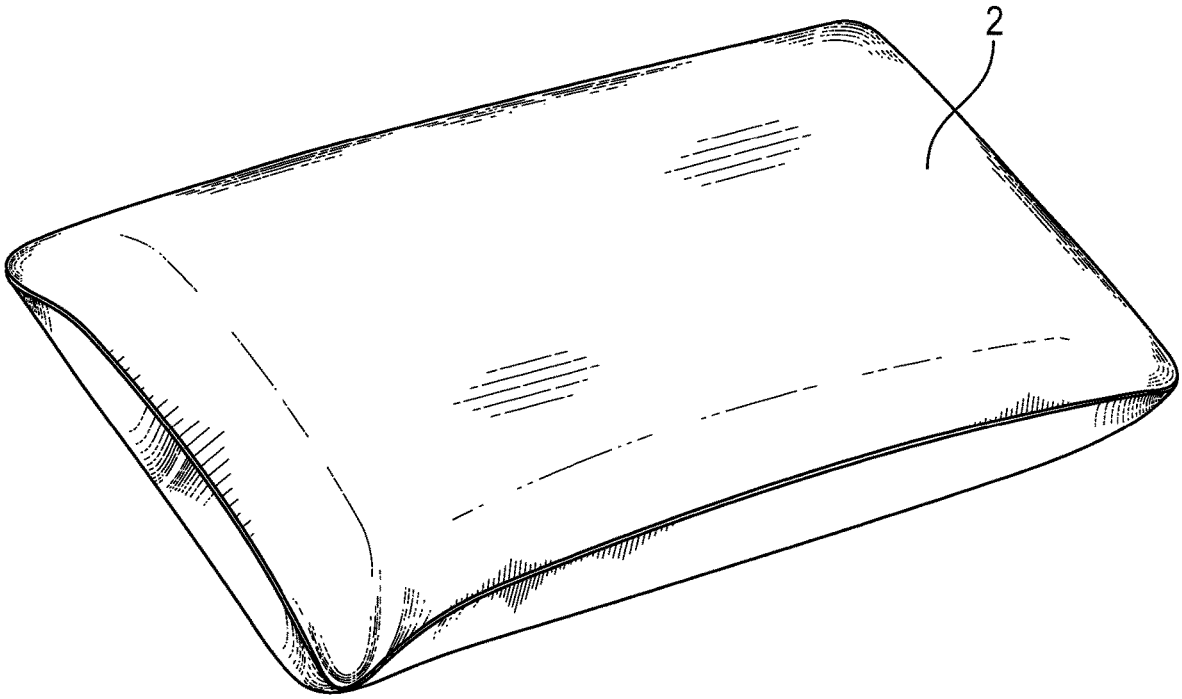
FIG. 1 is a top view of an exercise pad device.

Referring to FIG. 1, a top view of an exercise pad device is illustrated. The pad may be various sizes depending on the particular length and width desired. In various implementations the exercise pad device is sized large enough to cover a user's waist. In other implementations the exercise pad device may be wider or less wide than a user's waist. In a particular implementation, the exercise pad device is 18 inches wide by 8.5 inches tall, however, in other implementations, the length may be more or less long and the width more or less wide.

In various implementations, the pad's thickness ranges from half an inch to three inches; however, in other implementations the thickness of the pad may be larger or smaller than this range.

The exercise pad device may be various shapes. In the implementation illustrated by FIG. 1 the exercise pad device is rectangular, however, in other implementations the device may be circular, elliptical, hexagonal, or any other closed shape.

The exercise pad device may include a cover 2. The cover may couple to and enclose the interior of the exercise pad device. The cover may be made of various materials, such as, by non-limiting example, canvas, leather, nylon, ripstop nylon, polyethylene, polyester, polyvinyl chloride, polyvinyl fluoride, or any other durable polymer or fiber or combination of durable polymers or fibers.

In the implementation illustrated in FIG. 1, the cover 2 is fixedly closed around the entire interior of the exercise pad device. In various implementations, this may be done by sewing the cover around the material of the pad. In other implementations, the cover may be closed around the interior material of the pad through, by non-limiting example, gluing, heat bonding, melting, sewing, or any combination thereof. In various implementations the cover may have an opening allowing for the removal of interior portions of the exercise pad device. In implementations with such an opening, the opening may be reclosable. The opening may be reclosable through, by non-limiting example, hook and loop fasteners, snaps, buttons, a zipper, or any other openable and reclosable system or device.

Figure 2:
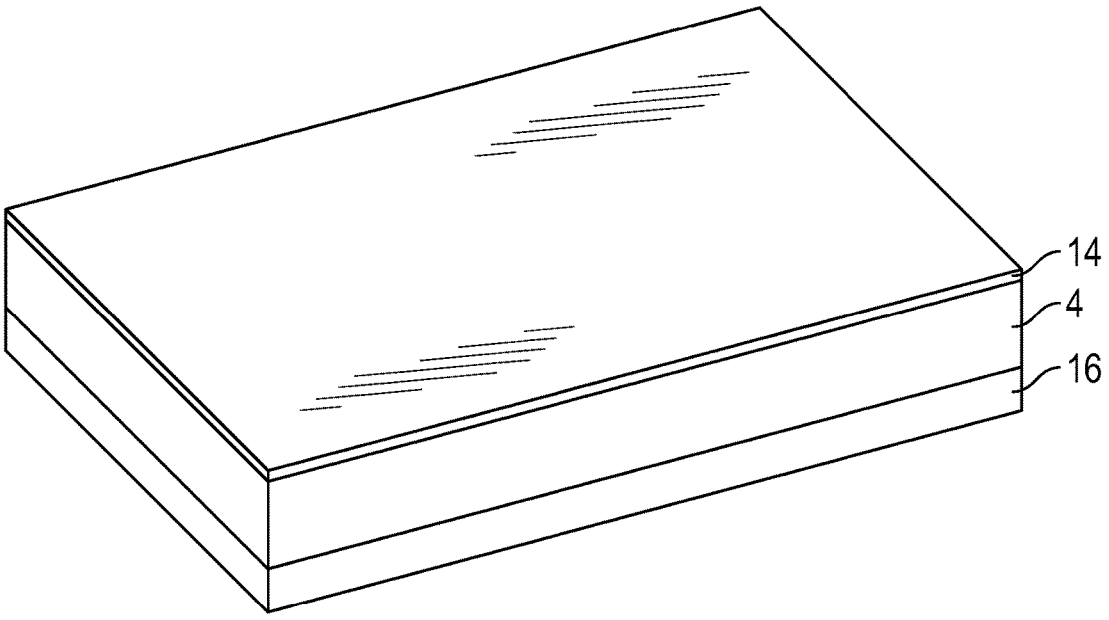
FIG. 2 is a perspective view of the interior layers of an implementation of an exercise pad device with a well in the pad portion.

Referring now to FIG. 2, a perspective view of the interior layers of an implementation of an exercise pad device with a well in the pad portion is illustrated. The exercise pad device includes a pad portion 4. The pad portion 4 may be made of various materials, such as, by non-limiting example, foam, rubber, or any other polymer or material that can reversibly deform and act as a pad. In implementations where foam or rubber is used, the pad portion 4 may be made of, by non-limiting example, carpet pad, foam rubber, closed cell foam, open cell foam, urethane foam, polyurethane foam, polyvinyl chloride foam, thermoplastic elastomers, ethylene vinyl acetate, or any other polymer or combination of polymers. In an implementation where the pad portion 4 is made of closed cell foam, the pad portion may be made of a foam marketed under the tradename VOLARA® by Sekisui Voltek, LLC of Lawrence, Mass. The pad portion 4 may be heterogeneous or homogenous in various implementations.

Though FIG. 2 is a view of an exercise pad device with a well in the pad portion, in some implementations, the pad portion may be a single uniform thickness and may not include a well. However, in such implementations, the effects of the use of the well which will be described further in this document will not be present. Further, in various implementations the pad portion may comprise multiple layers rather than a single layer as illustrated in FIGS. 2-3.

Figure 3:
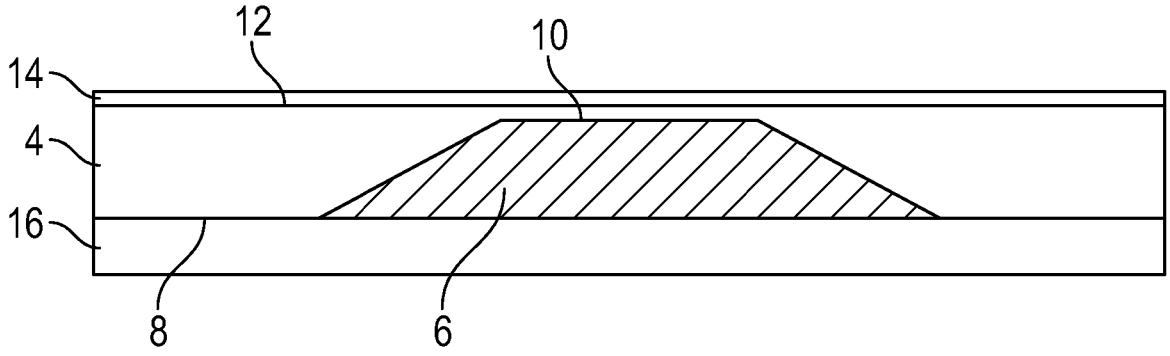
FIG. 3 is a cross sectional view of FIG. 2.

Referring now to FIG. 3, a cross sectional view of FIG. 2 is illustrated. As shown in the illustrated implementations, the pad portion includes a well 6. The well 6 may be substantially centered in the pad portion 4. In various implementations, the opening of the well may have a constant width from the opening of the well to the end of the well in the pad portion (straight sidewalls). In other implementations, the well may narrow/taper from an opening of the well in a first side 8 of a pad portion 4 to the end of the well 10 within the pad portion. In such implementations, the well may narrow at a continuous rate or it may narrow in a stepwise manner. In still other implementations, the well may widen from an opening in a second side 12 of the pad portion 4 to the end of the well within the pad portion. In various implementations, the well may be, by non-limiting example, conical, pyramidal, cylindrical, cuboidal, ovate, a conical frustum, a pyramidal frustum, or any other three dimensional shape. The well may vary in depth into the pad portion.

In various implementations, rather than having a well in the pad portion the pad portion may have a hole therethrough. In such implementations, the hole may be substantially centered in the pad portion 4. The hole may be circular, elliptical, rectangular, or any other shape. The hole may be a constant shape and size through the pad portion 4, or, in other implementations, the hole may narrow from an opening in a first side 8 of the pad portion 4 to a second side 12 of the pad portion 4. In implementations where the hole narrows, the hole may continuously narrow or it may narrow in a stepwise manner.

In various implementations containing a well or hole in the pad portion, the well or hole may be filled with a material that is more compressible/softer in feel than the rest of the pad portion.

In implementations containing a well or hole in the pad portion of the exercise pad device, the well or hole may be configured to reduce the localized pressure felt by a user when a barbell is placed over the exercise pad device while the user performs a hip thrust lift using the barbell. Without being bound by any theory, it is believed that this reduction in localized pressure experienced by the user is the result of having a hole substantially centered in the exercise pad device allowing the pressure from the weight of the barbell to be distributed from the center of the user out to the hips of the user. It is believed that the use of the well creates a pressure gradient across the user to reduce abdominal pressure and increase pressure at the hip areas, which feels better to the user while hip thrust exercises are being performed.

Referring to back to FIG. 2 and FIG. 3, the exercise pad device may include a protective layer 14. The protective layer is design to go between the pad portion and a barbell when a hip thrust exercise is performed. The protective layer is coupled to the second side 12 of the pad portion. The protective layer may be, by non-limiting example, a rubber sheet, a leather layer, a layer of canvas, or any other material that would protect the pad portion from tearing/cracking under the weight of the barbell during the repeated stresses experienced during a series of hip thrust exercises.

In various implementations the protective layer is 5 mm thick, however, in other implementations the protective layer may be more or less thick than this. The protective layer may be as wide and as long as the protective pad, however, in other implementations the protective layer may be more or less wide and not as long as or longer than the pad portion.

The exercise pad device may include a cushioning foam layer 16. The cushioning foam layer may be made from, by non-limiting example, carpet pad, foam rubber, closed cell foam, open cell foam, urethane foam, polyurethane foam, polyvinyl chloride foam, thermoplastic elastomers, ethylene vinyl acetate, or any other polymer or combination of polymers. In an implementation where the cushioning foam layer 16 is made of closed cell foam, the cushioning foam layer may be chloroprene elastomeric foam. The cushioning foam layer 16 may be heterogeneous or homogenous in various implementations.

The cushioning foam layer may be a continuous layer with no wells or holes, however, in various implementations the cushioning foam layer may also have a well or hole therein. In such implementations, the well or hole may or may not be aligned with the opening of the well in the pad portion.

The cushioning foam layer may be configured to go between the pad portion 4 and a user during a hip thrust lift. In various implementations, the cushioning foam layer 16 is coupled to a first side 8 of a pad portion.

The cushioning pad layer may be ½ an inch thick. In other implementations, the cushioning pad layer is more or less thick than ½ inch. In various implementations, the cushioning foam layer may be half as thick as the pad portion. The cushioning foam layer may be substantially same width and length of the pad portion 4.

Figure 4:
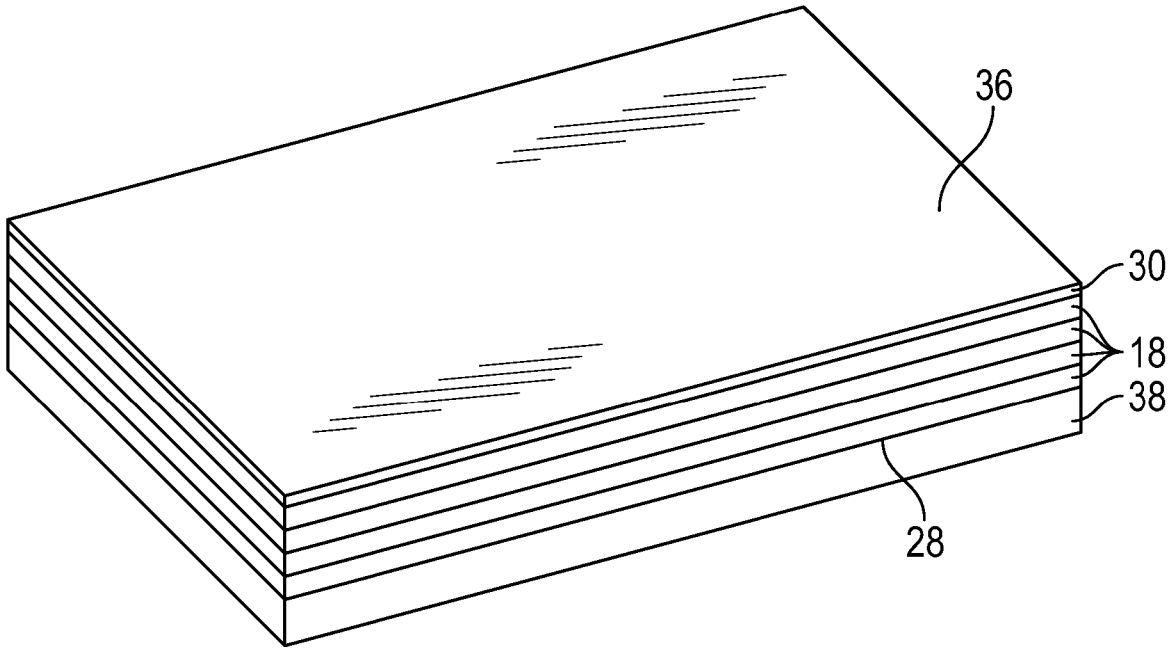
FIG. 4 is a perspective view of the interior layers of an implementation of an exercise pad device with holes through a plurality of foam layers.

Referring now to FIG. 4, a perspective view of the interior layers of an implementation of an exercise pad device with holes through a plurality of foam layers forming a well is illustrated. The exercise pad device may comprise a plurality of foam layers 18. Each foam layer in the plurality of foam layers 18 may have a hole therethrough. In various implementations, each foam layer in the plurality of foam layers may have a well, or a combination of holes and wells.

In various implementations, each foam layer within the plurality of foam layers is ¼ inch thick. In various implementations, each foam layer may be more or less thick than ¼ inch. Each foam layer may be the same thickness or they may vary in thickness. Each foam layer of the plurality of foam layers may be made from any material previously disclosed in this document.

In implementations where each foam layer of the plurality of foam layers has a hole, the holes may be substantially centered in each foam layer. In various implementations the holes may be rectangular, rounded rectangles, elliptical, circular, hexagonal, or any other closed shape.

Figure 5:
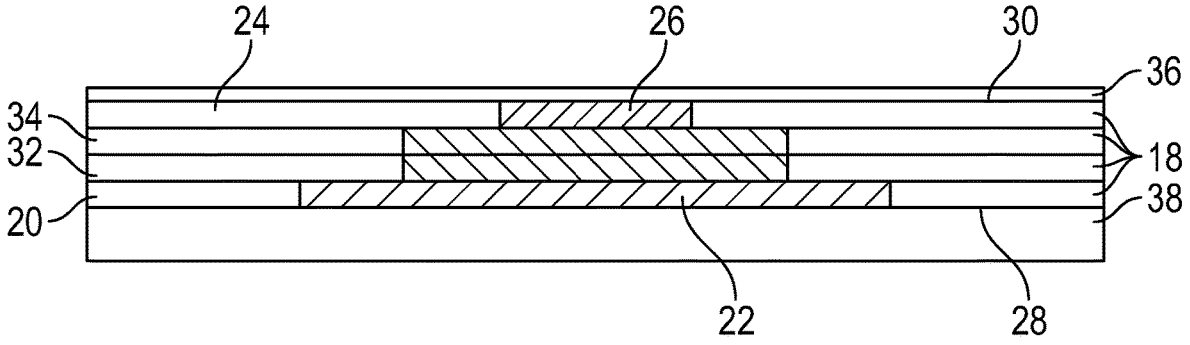
FIG. 5 is a cross sectional view of FIG. 4.
Figure 6:
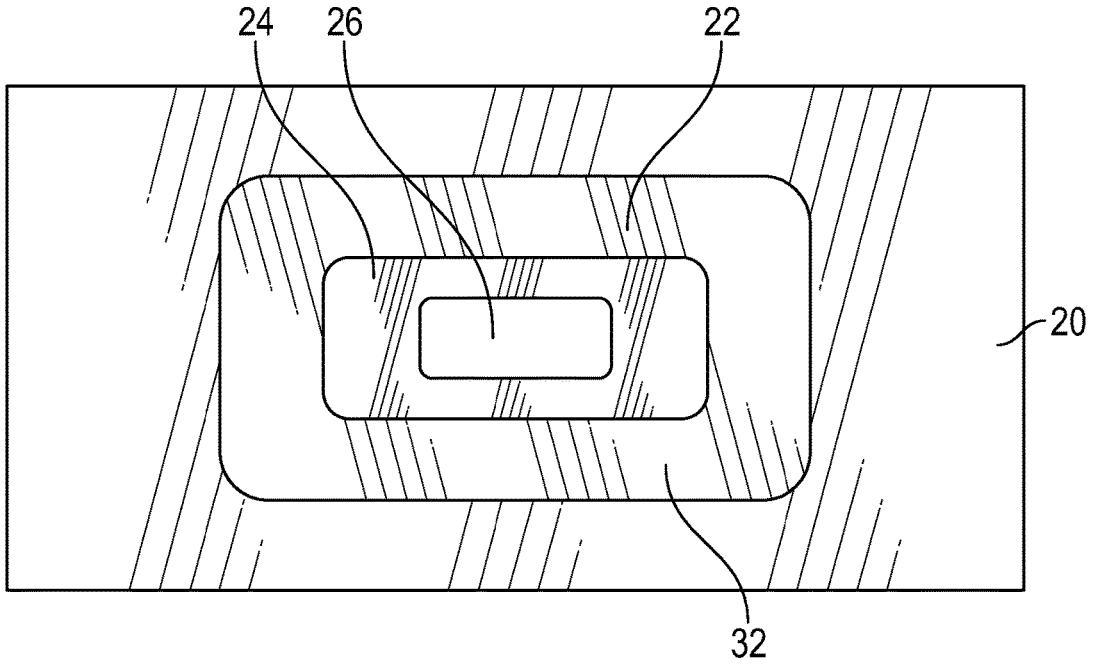
FIG. 6 is a bottom view of a plurality of foam layers of an exercise pad device with holes therethrough.

In various implementations the holes are the same size, while in other implementations the holes vary in size relative to each other. FIGS. 5-6 illustrate an implementation where the holes in the plurality of foam layers vary in size. Referring to FIG. 5, a cross sectional view of FIG. 4 is illustrated. Referring to FIG. 6, a bottom view of the plurality of foam layers illustrated in FIGS. 4 and 5 is illustrated. In implementations where the holes vary in size, the foam layer 20 with the largest hole 22 may be on a first side 28 of the plurality of foam layers 18. The foam layer 24 with the smallest hole 26 may be on a second side 30 of a plurality of foam layers 18. In the illustrated implementation, the exercise pad device may include foam layers 32 and 34 between foam layers 20 and 24. Foam layers 32 and 34 may have holes the same size and smaller than hole 22 but larger than hole 26. In other implementations, the hole in foam layer 32 may be larger than the hole in foam layer 34.

Referring back to FIG. 4, the exercise pad device may include a protective layer 36. The protective layer may be coupled to a second side 30 of the plurality of foam layers. The protective layer may be the same as or similar to the protective layers previously disclosed in this document.

The exercise pad device may include a cushioning foam layer 38. The cushioning foam layer 38 may be coupled to the first side 28 of the plurality of foam layers 18. The cushioning foam layer may be the same as or substantially similar to the cushioning foam layers previously disclosed in this document.

Figure 7:
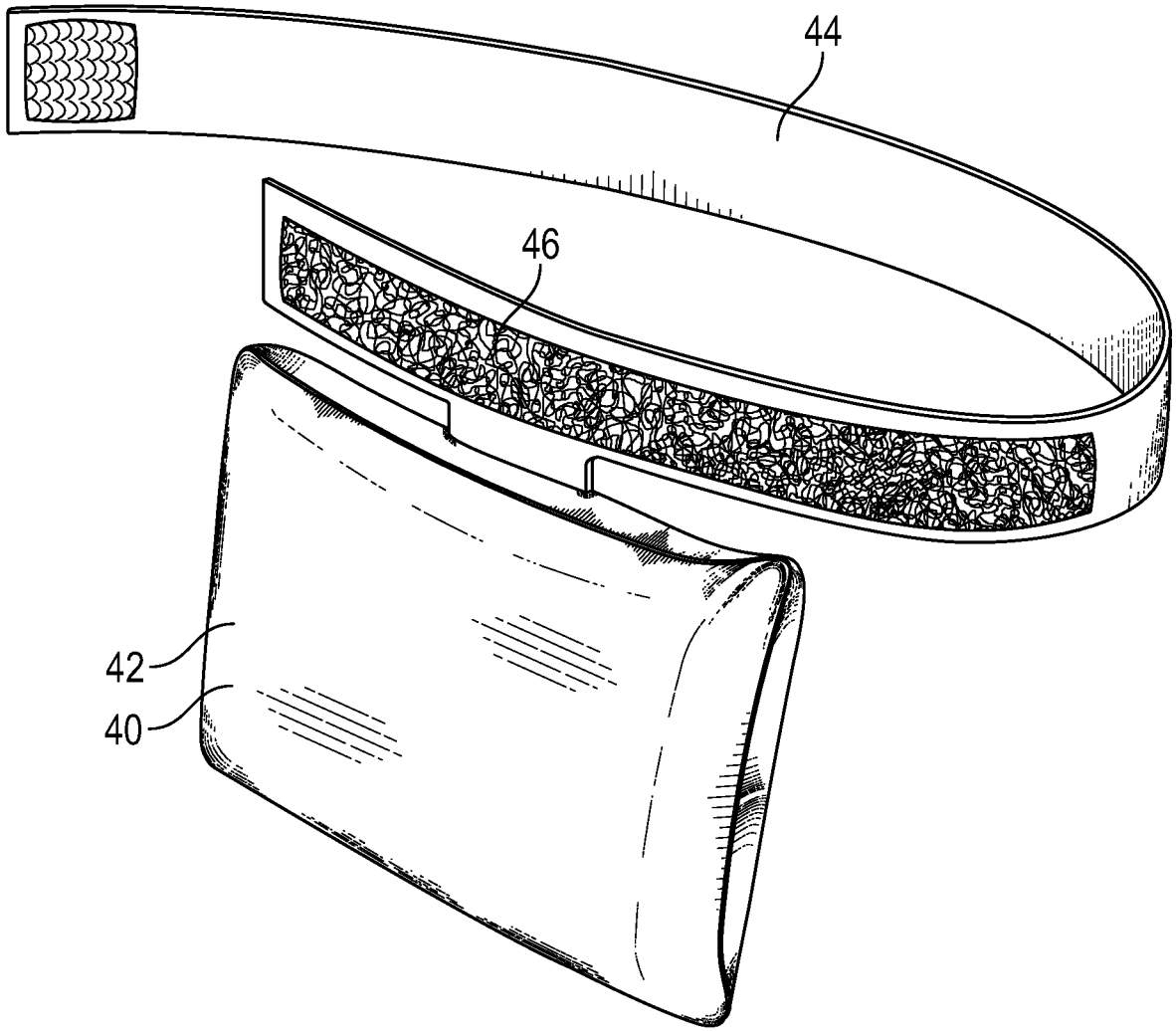
FIG. 7 is a perspective view of an exercise pad device coupled with a belt.

Referring now to FIG. 7, an exercise pad device coupled to a belt is illustrated. The exercise pad device 40 may be any exercise pad device previously disclosed in this document or the provisional application previously incorporated herein by reference. The cover 42 of the exercise pad device 40 may be coupled to a belt 44. The belt may be directly attached to the cover or it may be indirectly attached to the cover. In implementations where the belt is indirectly attached to the cover, the belt may be attached to another piece of fabric or material which is then directly attached to the cover. In various implementations the belt may be sewn or bonded directly or indirectly to the cover, however, in other implementations the belt may be removably attached to the cover.

The belt may be attached to a long edge of the cover as illustrated in FIG. 7, however, in other implementations, it may be attached to a side, face, or combination of a side, face, and edge of the cover (depending on the shape of the cover). The belt may be attached to an edge, side, or face of the cover along the entire length of the cover, or it may be attached to a portion of the edge, side, or face of the cover as shown in FIG. 7.

The belt may be coupled to the cover at an end portion 46 of belt 44. In various implementations, the belt may be attached to the cover at the middle of the belt or at any other point along the length of the belt.

The belt 44 may be of various lengths and widths. In various implementations, the belt may be at least long enough to wrap around the waist, abdomen, or rib cage of a user. In still other implementations, the belt may be wide enough to be comfortably worn by a user and in still other implementations, wide enough to offer back support to the user.

The belt 44 may be made of various materials, such as, by non-limiting example, leather, canvas, nylon, cloth, or any other flexible/elastic material, including those disclosed herein. In various implementations the belt has a degree of flexibility/elasticity along the width of the belt that is less than the degree of flexibility/elasticity along the length of the belt. In other implementations, the belt may be entirely elastic. In various implementations, the entire belt may be elastic or just select portions of the belt may be elastic.

The belt 44 may be joinable to itself. The belt may be joined to itself through use of, by non-limiting example, hook and loop fasteners, buckles, clasps, snaps, or any other coupling mechanism.

In places where the description above refers to particular implementations of an exercise pad device and implementing components, sub-components, methods and sub-methods, it should be readily apparent that a number of modifications may be made without departing from the spirit thereof and that these implementations, implementing components, sub-components, methods and sub-methods may be applied to other exercise pad devices.

What is claimed is:

1. An exercise pad device comprising:

a plurality of foam layers comprising a first side and a second side;

a protective layer coupled to the second side of the plurality of foam layers, wherein each foam layer of the plurality of foam layers comprises a hole therethrough, wherein each hole is substantially centered in each foam layer of the plurality of foam layers;

wherein the holes of at least two foam layers of the plurality of foam layers vary in size relative to each other;

wherein the foam layers are arranged with the largest hole in a foam layer on the first side of the plurality of foam layers and the smallest hole in a foam layer on the second side of the plurality of foam layers;

a cushioning foam layer coupled to the first side of the plurality of foam layers; and a cover coupled to and enclosing the protective layer, the plurality of foam layers, and the cushioning foam layer.

2. The exercise pad device of claim 1, wherein the plurality of foam layers comprises four layers.

3. The exercise pad device of claim 1, wherein the plurality of foam layers includes three foam layers, wherein the holes of the three foam layers vary in size relative to each other.

4. The exercise pad device of claim 1, wherein the holes are substantially rectangular.

5. The exercise pad device of claim 1, wherein a thickness of the plurality of foam layers is greater than a thickness of the cushioning foam layer.

6. The exercise pad device of claim 1, wherein the protective layer comprises a rubber sheet.

7. The exercise pad device of claim 1, wherein the plurality of foam layers comprises a closed cell foam.

* * * * *